United States Patent [19]

Flynn

[11] Patent Number: 4,659,045

[45] Date of Patent: Apr. 21, 1987

[54] TRASH BAGGING KIT

[76] Inventor: James P. Flynn, 309 W. Squire Dr., Apartment 3, Rochester, N.Y. 14623

[21] Appl. No.: 852,524

[22] Filed: Apr. 16, 1986

[51] Int. Cl.[4] ..... B65B 67/04

[52] U.S. Cl. ..... 248/99; 15/257.9

[58] Field of Search ..... 248/95, 97, 99, 100, 248/101; 15/257.9, 257.4, 257.8, 257.7; 294/1 R, 1 B, 55, 1 BA; 141/108, 328, 390, 391; 383/33; 53/384

[56] References Cited

U.S. PATENT DOCUMENTS

| | | | |
|---|---|---|---|
| 608,635 | 8/1898 | Bartholomew | 15/257.9 |
| 737,688 | 9/1903 | Wheeler | 15/257.9 |
| 2,914,787 | 12/1959 | Hartkopf | 15/257.9 X |
| 3,659,891 | 5/1972 | Pettenon | 294/55 X |
| 3,711,141 | 1/1973 | Soergew | 15/257.8 X |
| 3,934,803 | 1/1976 | Frederick | 141/390 X |
| 3,983,914 | 10/1976 | Benson | 53/384 X |
| 3,986,744 | 10/1976 | Krogstad | 15/257.6 X |
| 4,138,153 | 2/1979 | Brown | 294/55 X |
| 4,159,139 | 6/1979 | Gawedzinski | 15/257.7 X |
| 4,268,081 | 5/1981 | Hawkinson | 294/55 |

*Primary Examiner*—J. Franklin Foss

*Attorney, Agent, or Firm*—Stonebraker, Shepard & Stephens

[57] ABSTRACT

A hollow frame, of the general shape of the letter D, has a straight side adapted to rest on a horizontal supporting surface such as the ground or a floor, this straight side having sufficient dimensions to provide stability to hold the rest of the frame in an upright position in a vertical plane. A plastic trash bag has its open end inserted through the hollow frame and its margins folded back over the outer surfaces of the frame, so that the frame holds the mouth of the bag open, in position to receive trash inserted by an approximately horizontal motion. As the bag becomes more full, the frame may be lifted off the supporting surface, using convenient hand holes provided in the frame, and the partially filled bag may be placed upright, in which position the frame remains at the top of the bag and continues to hold the mouth of the bag open to receive more input. The bagging kit of the invention consists of this frame plus a sheet metal piece folded sharply to provide a main flange and a smaller inclined ramp flange which may be placed at the entrance of the bag when the frame is lying on the ground, so that dirt may be swept up the inclined ramp and into the bag, without being caught and stopped by the vertical edge or shoulder formed by the thickness of the wall forming the frame. The sheet metal piece may also be used as a dustpan, and as a scraper.

3 Claims, 6 Drawing Figures

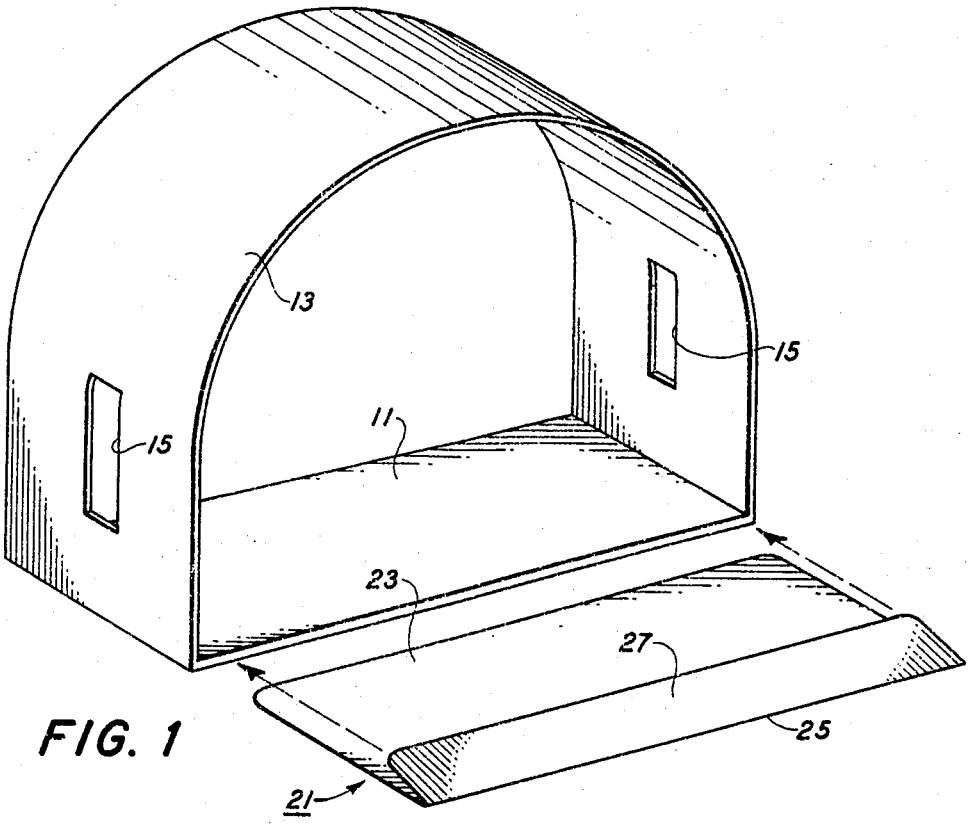
FIG. 1
FIG. 2
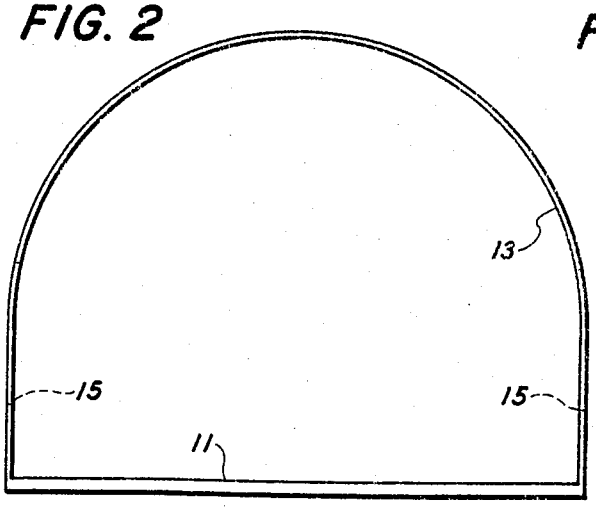
FIG. 3
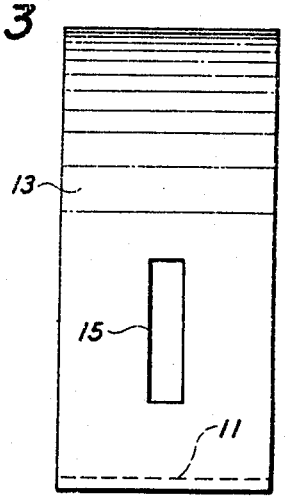

TRASH BAGGING KIT

This invention relates to a kit, or combination of different pieces of equipment intended to be used together, for conveniently bagging trash. The kit is particularly useful for the bagging of trash by a single person working alone.

When two persons work together, one may hold a bag or sack in convenient open position while the other person places leaves, lawn rakings, or other kinds of trash in the bag. Even when two persons are working together, the one holding the bag often can not hold the mouth of the bag open with enough area to receive the contents of a large shovel, or of a pail full of debris, without spilling some outside of the bag. The task is much more difficult for a person working alone without a helper. When one tries to hold a floppy lawn bag or trash bag open with one hand while manipulating a shovel or rake or broom or pail full of trash with the other hand, managing to get the desired material safely into the bag becomes a major accomplishment.

Some aids have been proposed in the past. For example, certain hand trucks are equipped with a rectangular metal loop which can extend horizontally from an upright handle portion of the truck. A lawn bag can be placed inside the loop, with upper margins folded over the loop and held in place by a longitudinally elastic cord, sometimes called a Bungay cord, extending peripherally around the circumference of the metal loop. But this is an attachment to a relatively expensive hand truck, and can not, as a practical matter, be used separately from the truck. It has also been proposed to provide a circular hoop to receive a bag and hold it open, with a resdilient split ring surrounding the hoop to clamp the foldedover edges of the bag in place. This is not satisfactory or efficient, as it falls flat on the ground or floor, and does not really hold the bag in position to provide a cavity of substantial size to receive trash or refuse.

SUMMARY OF THE INVENTION

An object of the present invention is the provision of a simple, lightweight, and inexpensive device capable of easy, efficient, and rapid use by a person working alone, to hold trash bags, leaf bags, and the like in an open mouth position for receiving input.

Another object of the invention is the provision, in combination with the foregoing, of means serving as an inclined ramp whereby remnants of dirt or trash may be swept from a floor or flat surface up the ramp and into the open mouth of the bag, the ramp means also serving, in another position, as a dustpan or trash scraping tool.

According to the present invention, a holder is provided for holding the mouth of a bag open in an initially upright vertical position, with the body of the bag extending horizontally along the ground or floor from the open end, to provide plenty of room so that a shovel full or pail full of trask or refuse may be thrown into open bag. An important feature of the invention is that the holding means holds a substantial portion of the circumference of the bag mouth flat against the floor or ground on which the device rests, so that leaves or other trash items may easily be swept into the bag by a broom or the like. Another feature is that the kit of the present invention includes a member or element which provides an inclined ramp leading from the floor level up over the thickness of the wall of the holding device, so that the last remnants of trash or dirt may be easily swept by a broom or hand brush up this ramp and into the open bag. Finally, the ramp member or element itself serves also the dual purpose or function of a dustpan. It may be removed from its rampforming position, and it then forms a convenient dustpan or scraping tool for gathering up scraps or remnants of trash and throwing them into the open bag.

As the bag becomes more full, the holder which initially rests on the floor or ground and holds the open end of the bag in an upright vertical position is lifted up from the floor. The contents of the bag then causes the bag to expand below the holder, so that the expanded or bulging shape of the bag now supports the holder in a horizontal position, still keeping the mouth of the bag fully open to receive more material.

BRIEF DESCRIPTION OF THE DRAWINGS

In the accompanying drawings, which illustrate a preferred exemplary embodiment of the invention, FIG. 1 is a perspective illustration of the two parts or members which together comprise the kit of the present invention;

FIG. 2 is a front elevational view of the main member or "D-Box" portion of the kit;

FIG. 3 is a side elevation of the same;

DESCRIPTION OF THE PREFERRED EMBODIMENT

Figure 4:
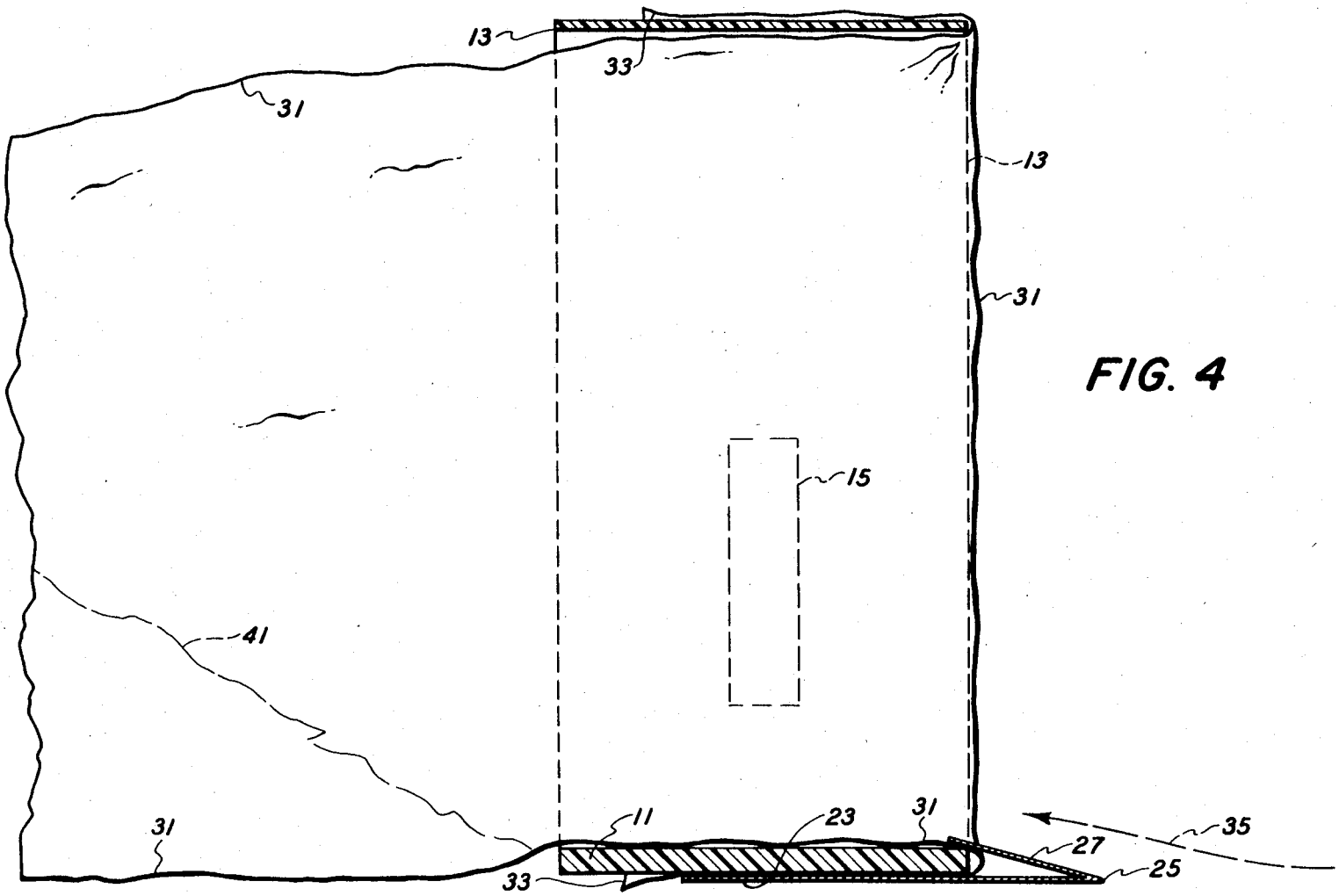
FIG. 4 is a vertical section through the two members of the kit in assembled working relation to each other and with a fragment of a trash bag in open trash-receiving position.

Referring first to FIGS. 1–3, the preferred form of the invention has a main or principal member which may be called a D-box, since it has roughly the shape of a capital letter D. It has one flat side 11, and a curved or arched side 13 the two ends of which connect with the two ends of the flat side 11, as shown. The structure may be of various sizes, depending on the size of the bag or sack with which it is to be used. Conveniently, the length of the flat side 11 is 16 inches, and the height from the flat side 11 to the top of the arched wall 13 is from 11 to 12 inches. With these dimensions, the device will accommodate all of the standard commonly used sizes of plastic trash bags from the so-called 26 gallon size to the so-called 39 gallon size.

The width of the members 11 and 13, that is, their dimension from left to right in FIG. 3, or perpendicular to the plane of the paper in FIG. 2, is preferably 6 inches. This is sufficient to give the structure a good stability on the floor or lawn or other surface on which it rests during use. A dimension materially less than about 6 inches is likely to give the structure insufficient stability, so that it may easily tip over instead of standing upright, especially if placed on a rough or uneven lawn. A dimension materially greater than 6 inches adds unnecessarily to the bulk and weight of the article, and makes it awkward to handle, and tends to defeat the objective of having a simple, light, compact, and inexpensive article.

The side walls of this D-box unit have hand-hold openings 15, positioned as illustrated in FIGS. 1 and 3. Each of these openinga is about 4 to 5 inches long and 1½ to 2 inches wide, to allow ample space for insertion of the four fingers of a person's hand even when displacing inwardly through this hand-hold opening a portion of a plastic bag, as further explained below.

This D-box member or unit may be made of any convenient material, such as metal or wood or plastic. The thickness of the walls will depend on the material from which they are made. If of wood, the bottom or flat wall 11 may be, for example, about ¼ inch thick, and the curved or arched wall say about ⅛ inch, or thin enough to be curved to the desired shape, depending on the kind of wood used. If the walls are made of sheet metal, or of plastic, they need be only thick enough to have the desired reasonable amount of rigidity.

The second unit or part or member of the kit, used in combination with the D-box member, is indicated in general at 21. It may be called a ramp member or a dust-pan member, since it serves the function of both. This second member is made of sheet metal, and has a main flat area 23 whose dimensions are a little less than the inside dimensions of the flat bottom wall 11 of the first unit, so that it can enter the first unit easily, with some room to spare at the ends. For example, if the inside dimensions of the wall 11 of the first unit or D-box unit are 6×16 inches, then the main area 23 of the second unit may conveniently be 5×15 inches.

At one edge of this main area 23, the sheet metal is bent sharply back upon itself to form a thin bent edge 25 and a ramp flap or inclined flange 27 as clearly seen in FIGS. 1 and 4. This ramp 27 is about 1½ or 2 inches wide, and the same length as that of the main area 23.

Figure 5:
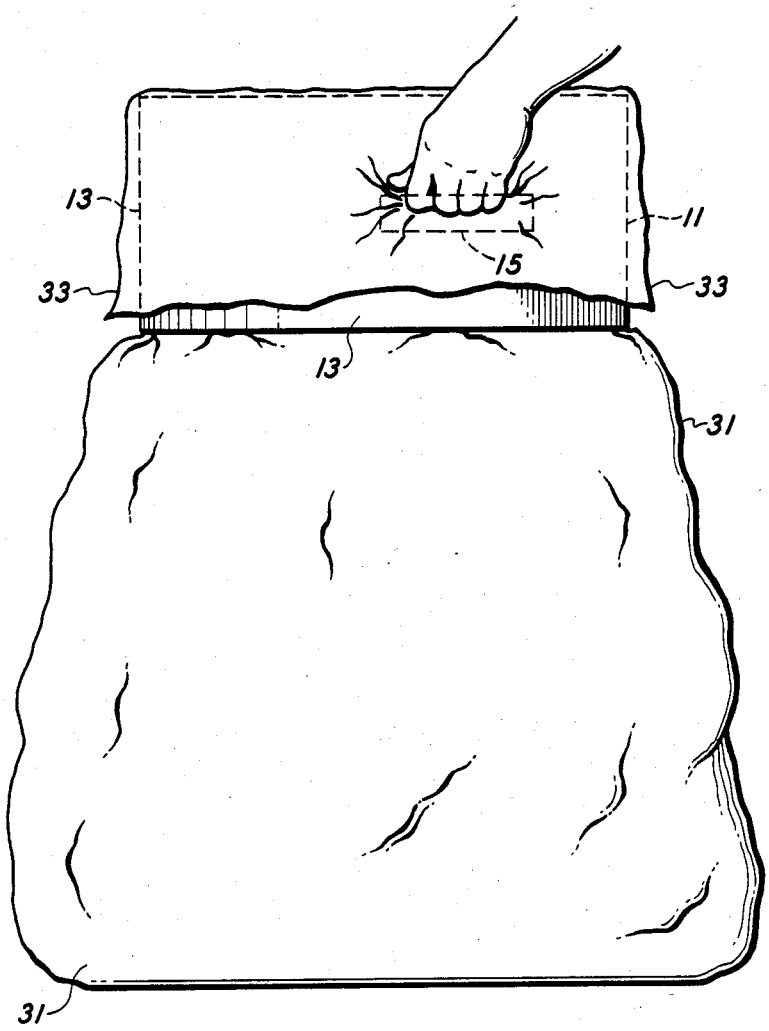
FIG. 5 is a side elevation of the main or D-box member with attached bag of trash being lifted by a person.
Figure 6:
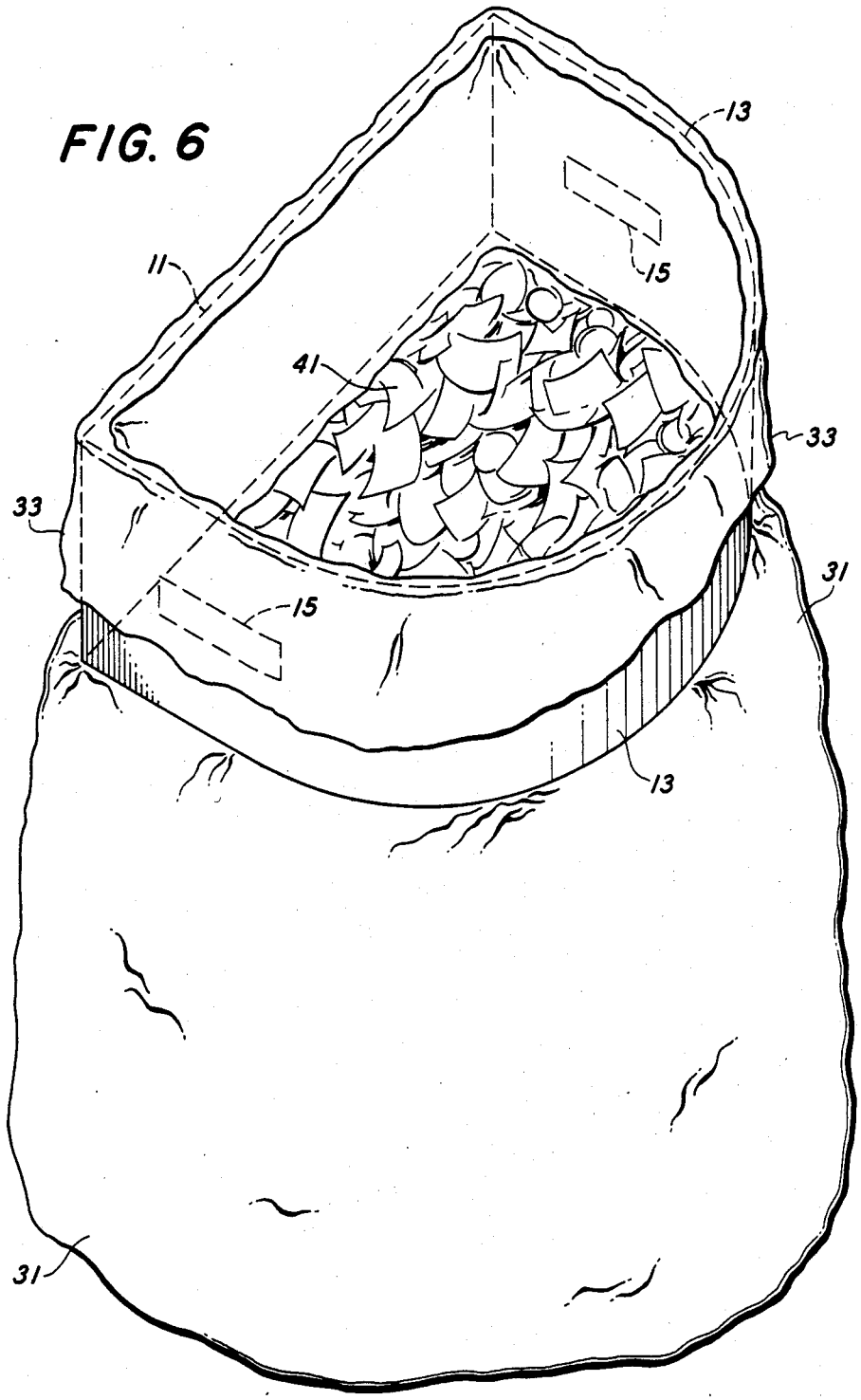
FIG. 6 is a perspective view of an almost full bag of trash with the main kit member or D-box attached to the bag.

The usefulness of these two units (the D-box unit and the dustpan unit) which together make up the kit, is illustrated in FIGS. 4–6. A conventional plastic trash bag or lawn bag, available on the market in various sizes, is indicated at 31. The open end of the bag is drawn through the D-box and the marginal edges of the bag are folded back around the outside of the D-box as indicated at 33. Then the D-box is laid down with its flat side resting on any flat supporting surface, such as a lawn, or patio, or garage floor, or wherever trash is to be bagged.

The flat wall area of the D-box gives it sufficient stability so that it does not fall over, but remains upright, holding the mouth of the bag open in a vertical plane, the length of the bag extending horizontally from the open end. In this position, trash and debris can easily be inserted into the bag with a horizontal motion, being thrown in horizontally, or shovelled in, or swept in with a broom. No helper is needed to hold the bag open. A person working alone is able to work efficiently.

For gathering up the last remnants of trash, especially from a smooth surface such as a garage floor or a patio, the second unit or dustpan-ramp unit of the kit comes into play. This second unit is placed in the position shown in FIG. 4, with the main area on the floor beneath the D-box, and with the angular flange forming an inclined ramp at the front edge of the bottom wall of the D-box. Then a broom or hand brush may be used to sweep the dust and dirt in the direction of the arrow 35 (FIG. 4), up the inclined ramp and into the bag. The inclined ramp prevents the debris from catching and accumulating at the vertical edge of the bottom wall of the D-box, as it would do if the ramp were not present. Also, the ramp serves to protect the folded edge of the bag from being cut by broken glass or other sharp objects being swept into the bag. The ramp and dustpan unit may also be used as a dustpan, being held in one hand by grasping the angular edge, placing the opposite edge tight against the floor, and brushing dirt onto the large area of the pan, just as onto an ordinary dustpan. Also, while holding the article by the angular or folded edge, the opposite edge may be used as a scraper for scraping up dust and debris into a pile, preliminary to putting it into the bag.

As the bag gets more full, the bag may be stood upright on the floor (or lawn) with the D-box still remaining on the bag to keep the mouth of the bag open to receive more input. One may grasp the bag and D-box together by placing the fingers through the two hand holes as illustrated in FIG. 5, with enough force to displace the plastic bag inwardly through the holes so that the bag is firmly gripped, as well as the box frame itself, and the bag does not fall away when the D-box is lifted from the ground position. Then the bag is stood upright in the FIG. 5 position. The contents causes the bag to expand or belly out below the D-box, forming a shoulder which supports the D-box. As more and more material is added to the bag, the D-box is grasped and raised from time to time, until the bag is filled to the desired extent of its capacity. An approximately full bag, containing trash indicated schematically at 41, is shown in FIG. 6. The D-box is then removed, and the bag is tied closed, and disposed of in the normal way.

It is seen that this simple, inexpensive, and compact kit will provide an efficient means for keeping the mouth of the bag open to receive input, and an easy way to sweep remnants into the bag without being impeded by a vertical edge or shoulder, all in a way that can be handled easily by a single person, needing no second person to help.

What is claimed is:

1. A trash bagging kit comprising, in combination, a bag holding unit and a ramp unit, said bag holding unit comprising a hollow frame having the general outline of the letter D, with a flat side and a curved wall whose ends terminate at the ends of said flat side, said frame being adapted to have an open end of a trash bag inserted through said frame with marginal portions of the bag folded back over the outside of the frame and to have the flat side of the frame laid on a flat supporting surface with the curved wall of the frame rising upwardly, whereby the bag will be held in an open position to receive input, said ramp unit comprising two stiff sheet portions meeting each other at an acute angle to form a thin edge, the space between said two sheet portions being completely open along its thicker side for easy discharge of any material accumulating between said two sheet portions when said ramp unit is used as a scraper and dustpan and for easy entrance of said flat side of said frame with bag folded thereover into said space between said two sheet portions, one of said sheet portions being substantially larger than the other and being adapted to be placed under said flat side of said frame when said flat side is placed on a supporting surface, with the other of said sheet portions overlying an edge of said flat side of said frame and protecting a portion of said bag folded over said edge and forming an inclined ramp up which material may be swept from said supporting surface into the open bag held by said frame.

2. The kit defined in claim 1, wherein said curved wall of said frame has two hand holes located respectively near opposite ends of said flat side, through which fingers of a person's hand may be placed to lift said frame and bag attached thereto, said hand holes being located in a region of said curved wall normally covered by said marginal portions of said bag folded back over the outside of said frame and being of sufficient size so that fingers of a person may push slack portions of said bag covering said hand holes through said hand holes in order that the fingers themselves may enter the hand holes.

3. The kit defined in claim 1, wherein said frame constituting said bag holding unit is an integral one-piece structure.

* * * * *